US006668062B1

(12) United States Patent
Luo et al.

(10) Patent No.: US 6,668,062 B1
(45) Date of Patent: Dec. 23, 2003

(54) FFT-BASED TECHNIQUE FOR ADAPTIVE DIRECTIONALITY OF DUAL MICROPHONES

(75) Inventors: Fa-Long Luo, Redwood City, CA (US); Brent Edwards, San Francisco, CA (US); Jun Yang, Redwood City, CA (US); Nick Michael, San Francisco, CA (US)

(73) Assignee: GN ReSound AS, Taastrup (DK)

( * ) Notice: Subject to any disclaimer, the term of this patent is extended or adjusted under 35 U.S.C. 154(b) by 0 days.

(21) Appl. No.: 09/567,860

(22) Filed: May 9, 2000

(51) Int. Cl.[7] ..... H04R 3/00

(52) U.S. Cl. ..... 381/122; 381/92; 381/71.12; 704/226

(58) Field of Search ..... 381/122, 92, 91, 381/71.11, 71.14, 313, 316, 317, 94.3, 94.2, 94.7, 356, 71.12; 704/322, 226, 233

(56) References Cited

U.S. PATENT DOCUMENTS

| | | | | |
|---|---|---|---|---|
| 5,400,409 A | | 3/1995 | Linhard | 381/92 |
| 5,539,859 A | * | 7/1996 | Robbe et al. | 704/226 |
| 5,581,620 A | | 12/1996 | Brandstein et al. | 381/92 |
| 5,627,799 A | | 5/1997 | Hoshuyama | 367/121 |
| 5,754,665 A | | 5/1998 | Hosoi | 381/94.1 |
| 5,825,898 A | | 10/1998 | Marash | 381/94.1 |
| 5,917,921 A | | 6/1999 | Sasaki et al. | 381/94 |
| 6,178,248 B1 | | 1/2001 | Marash | 381/94.7 |

* cited by examiner

*Primary Examiner*—Xu Mei
(74) *Attorney, Agent, or Firm*—Bingham McCutchen LLP; David G. Beck

(57) ABSTRACT

The present invention comprises an adaptive directionality dual microphone system in which the time domain data from the first and second microphones is converted into frequency domain data. The frequency domain data is then manipulated to produce a noise-canceled signal which is converted in an Inverse Fourier Transform block into noise-cancel time domain data.

10 Claims, 8 Drawing Sheets

FFT-BASED TECHNIQUE FOR ADAPTIVE DIRECTIONALITY OF DUAL MICROPHONES

BACKGROUND OF THE INVENTION

The present invention relates to systems which use multiple microphones to reduce the noise and to enhance a target signal.

Such systems are called beamforming systems or directional systems. FIG. 1 shows a simple two-microphone system that uses a fixed delay to produce a directional output. The first microphone 22 is separated from the second microphone 24 by distance. The output of the second microphone 24 is sent to a constant delay 26. In one case, a constant delay, d/c where c is the speed of sound, is used. The output of the delay is subtracted from the output of the first microphone 22. FIG. 1B is a polar pattern of the gain of the system of FIG. 1A. The delay d/c causes a null for signals coming from the 180° direction. Different fixed delays produce polar patterns having nulls at different angles. Note that at the zero degree direction, there is very little attenuation. The fixed directional system of FIG. 1A is effective for the case that the target signal comes from the front and the noise comes exactly from the rear, which is not always true.

If the noise is moving or time-varying, an adaptive directionality noise reduction system is highly desirable so that the system can track the moving or varying noise source. Otherwise, the noise reduction performance of the system can be greatly degraded.

FIG. 2 is a diagram in which the output of the system is used to control a variable delay to move the null of the directional microphone to match the noise source.

The noise reduction performance of beamforming systems greatly depends upon the number of microphones and the separation of these microphones. In some application fields, such as hearing aids, the number of microphones and distance of the microphones are strictly limited. For example, behind-the-ear hearing aids can typically use only two microphones, and the distance between these two microphones is limited to about 10 mm. In these cases, most of the available algorithms deliver a degraded noise-reduction performance. Moreover, it is difficult to implement, in real time, such available algorithms in this application field because of the limits of hardware size, computational speed, mismatch of microphones, power supply, and other practical factors. These problems prevent available algorithms, such as the closed-loop-adapted delay of FIG. 2, from being implemented for behind-the-ear hearing aids.

It is desired to have a more practical system for implementing an adaptive directional noise reduction system.

SUMMARY OF THE PRESENT INVENTION

The present invention is a system in which the outputs of the first and second microphones are sampled and a discrete Fourier Transform is done on each of the sampled time domain signals. A further processing step takes the output of the discrete Fourier Transform and processes it to produce a noise canceled frequency-domain signal. The noise canceled frequency-domain signal is sent to the Inverse Discrete Fourier Transform to produce a noise canceled time domain data.

In one embodiment of the present invention, the noise canceled frequency-domain data is a function of the first and second frequency domain data that effectively cancels noise when the noise is greater than the signal and the noise and signal are not in the same direction from the apparatus. The function provides the adaptive directionality to cancel the noise.

In another embodiment of the present invention, the function is such that if $X(\omega)$ represents one of the first and second digital frequency-domain data and $Y(\omega)$ represents the other of the first and second digital frequency-domain data, the function is proportional to $X(\omega)[1-|Y(\omega)|X(\omega)|]$.

The present invention operates by assuming that for systems in which the noise is greater than the signal, the phase of the output of one of the Discrete Fourier Transforms can be assumed to be the phase of the noise. With this assumption, and the assumption that the noise and the signal come from two different directions, an output function which effectively cancels the noise signal can be produced.

In an alternate embodiment of the present invention, the system includes a speech signal pause detector which detects pauses in the received speech signal. The signal during the detected pauses can be used to implement the present invention in higher signal-to-noise environments since, during the speech pauses, the noise will overwhelm the signal, and the detected "noise phase" during the pauses can be assumed to remain unchanged during the non-pause portions of the speech.

One objective of the present invention is to provide an effective and realizable adaptive directionality system which overcomes the problems of prior directional noise reduction systems. Key features of the system include a simple and realizable implementation structure on the basis of FFT; the elimination of an additional delay processing unit for endfire orientation microphones; an effective solution of microphone mismatch problems; the elimination of the assumption that the target signal must be exactly straight ahead, that is, the target signal source and the noise source can be located anywhere as long as they are not located in the same direction; and no specific requirement for the geometric structure and the distance of these dual microphones. With these features, this scheme provides a new tool to implement adaptive directionality in related application fields.

DETAILED DESCRIPTION OF THE PREFERRED EMBODIMENT

Figure 1A:
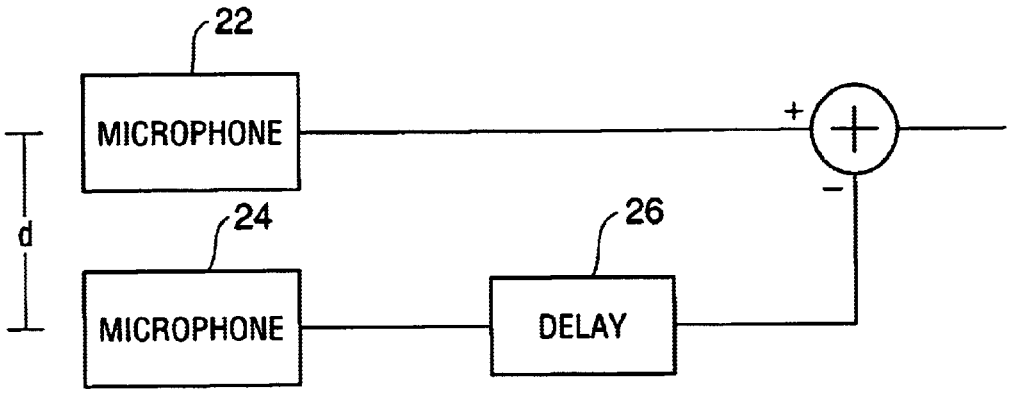
FIG. 1A (PRIOR ART)
FIG. 1A is a diagram of a prior-art fixed-delay directional microphone system.
Figure 1B:
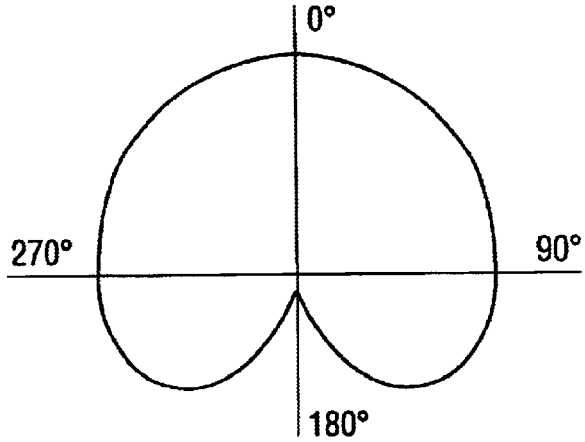
FIG. 1B (PRIOR ART)
FIG. 1B is a diagram of a polar pattern illustrating the gain with respect to angle for the apparatus of FIG. 1A.
Figure 2:
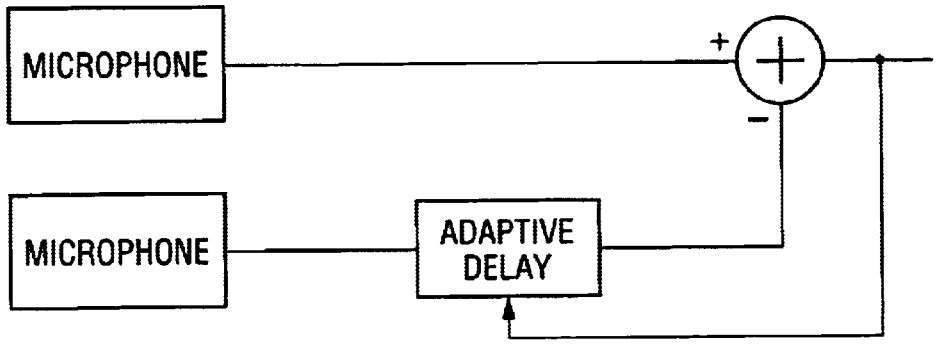
FIG. 2 (PRIOR ART)
FIG. 2 is a diagram of a prior-art adaptive directionality noise-cancellation system using a variable delay.
Figure 3:
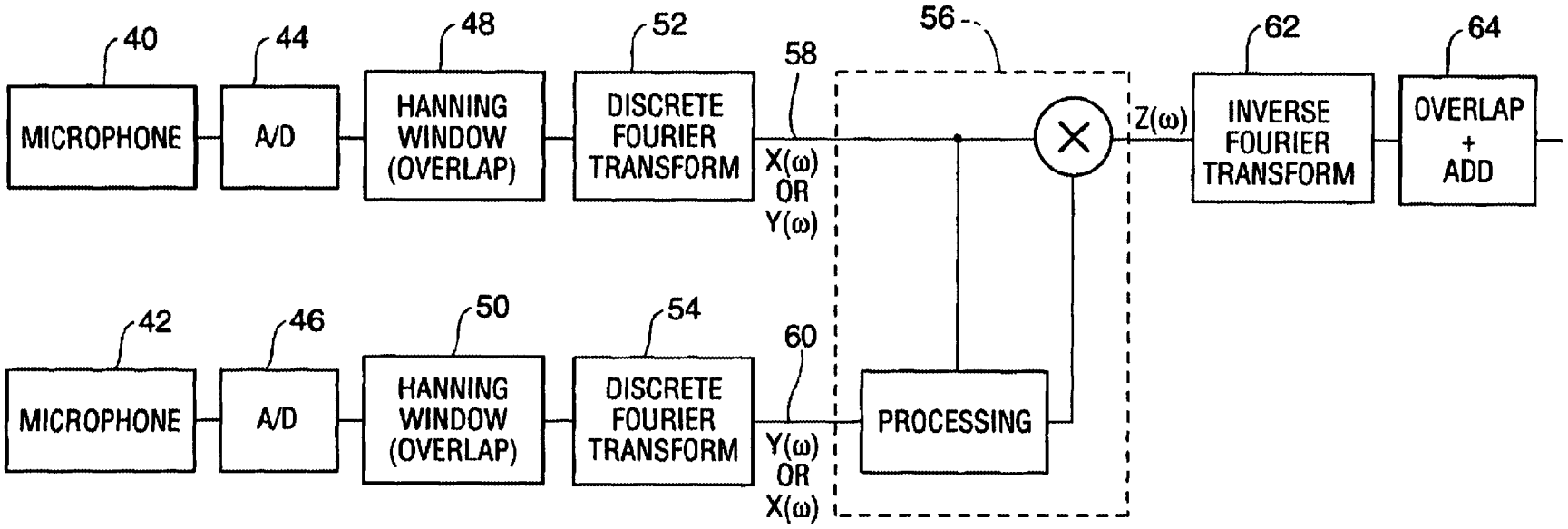
FIG. 3 is a diagram of the adaptive directionality system of the present invention, using a processing block after a discrete Fourier Transform of the first and second microphone outputs.

FIG. 3 is a diagram that shows one embodiment of the present invention. First and second microphones 40 and 42 are provided. If the system is used with a behind-the-ear hearing aid, the first and second microphones will typically be closely spaced together with about 10 mm separation. The outputs of the first and second microphones can be processed. After any such processing, the signals are sent to the analog-to-digital converters 44 and 46. The digitized time domain signals are then sent to a Hanning window overlap block 48 and 50. The Hanning window selects frames of time domain data to send to the Discrete Fourier Transform blocks 52 and 54. The Discrete Fourier Transform (DFT) in a preferred embodiment is implemented as the Fast Fourier Transform (FFT). The output of the DFT blocks 52 and 54 correspond to the first microphone 40 and second microphone 42, respectively. In the processing block 56, the data on line 58 can be considered to be either the frequency domain data X(ω) or Y(ω). Thus, the frequency domain data on line 60 will be Y(ω) when line 58 is X(ω), and X(ω) when the data on line 58 is Y(ω). In one embodiment, the processing produces an output Z(ω) given by (Equation 1):

$$Z(\omega) = X(\omega) - X(\omega)\frac{|Y(\omega)|}{|X(\omega)|}$$

Alternately the processing output can be given by (Equation 2):

$$Z(\omega) = Y(\omega) - Y(\omega)\frac{|X(\omega)|}{|Y(\omega)|}$$

The output of the processing block 56 is sent to an Inverse Discrete Fourier Transform block 62. This produces time domain data which is sent to the overlap-and-add block 64 that compensates for the Hanning window overlap blocks 48 and 50.

In one embodiment, the outputs of the DFT blocks 52 and 54 are bin data, which is operated on bin-by-bin by the processing block 56. Function Z(ω) for each bin is produced and then converted in the Inverse DFT block 62 into time domain data.

Algorithm and Analysis

For a dual-microphone system, let us denote the received signals at one microphone and the other microphone as X(n) and Y(n), their DFTs as X(ω) and Y(ω), respectively. The scheme is shown in FIG. 3. It will be proven that either of Equation 1 or Equation 2 can provide approximately the noise-free signal under certain conditions. Note that in the present invention there is no assumed direction of the noise or the target signal other than that they do not coexist. The processing can be done using Equation 1 or Equation 2 where Z(ω) is the DFT of the system output Z(n). The conditions mainly include:

1. The magnitude responses of two microphones should be the same.

2. The power of the noise is larger than that of the desired signal. With the first condition, we have:

$$X(\omega)=|X(\omega)|e^{j\psi(\omega)}=|S(\omega)|e^{j\psi(\omega)}+|N(\omega)|e^{j\psi_n(\omega)}$$

$$Y(\omega)=|Y(\omega)|e^{j\psi_y(\omega)}=|S(\omega)|e^{j\psi_s(\omega)-j\psi_{sd}(\omega)}+|N(\omega)|e^{j\psi_n(\omega)-j\psi_{nd}(\omega)}$$

(denoted by Equation 3 and Equation 4, respectively), where various quantities stand for:

1. $|X(\omega)|$, $\psi_x(\omega)$, and $|Y(\omega)|$, $\psi_y(\omega)$ are the magnitude and phase parts of X(ω) and Y(ω), respectively.

2. $|S(\omega)|$, $\psi_s(\omega)$, and $|N(\omega)|$, $\psi_n(\omega)$ are the magnitude and phase parts of the desired signal S(ω) and the noise N(ω) at the first microphone, respectively.

3. $\psi_{sd}(\omega)$ and $\psi_{nd}(\omega)$ are the phase delay of the desired signal and noise in the second microphone, respectively, which includes all phase delay, that is, the wave transmission delay, phase mismatch of two microphones, etc.

Because the noise power is larger than the signal power, we have the following approximations (Equation 5):

$$\psi_x(\omega)\approx\psi_n(\omega)$$

$$\psi_y(\omega)\approx\psi_n(\omega)-\psi_{nd}(\omega)$$

Substituting Equation 5 into Equation 1 yields:

$$\begin{aligned}
Z(\omega) &= X(\omega) - X(\omega)\frac{|Y(\omega)|}{|X(\omega)|} = X(\omega) - Y(\omega)e^{-j\Psi_y(\omega)}e^{j\Psi_x(\omega)} \\
&= |S(\omega)|e^{j\Psi_s(\omega)} + |N(\omega)|e^{-j\Psi_n(\omega)} - Y(\omega)e^{j\Psi_{nd}(\omega)} \\
&= |S(\omega)|e^{j\Psi_s(\omega)} + |N(\omega)|e^{-j\Psi_n(\omega)} - |S(\omega)|e^{j\Psi_s(\omega)}e^{j\Psi_{nd}(\omega)-j\Psi_{sd}(\omega)} - \\
&\quad |N(\omega)|e^{-j\Psi_n(\omega)} \\
&= |S(\omega)|e^{j\Psi_s(\omega)} - |S(\omega)|e^{j\Psi_s(\omega)}e^{j\Psi_{nd}(\omega)-j\Psi_{sd}(\omega)}
\end{aligned}$$

This scheme can be implemented for performing two Fast Fourier Transforms (FFTs) and one Inverse Fast Fourier Transform (IFFT) for each frame of data. The size of the frame will be determined by the application situations. Also, for the purpose of reducing the time aliasing problems and its artifacts, windowing processing and frame overlap are required.

Note that, typically, at least one FFT and one IFFT are required in other processing parts of many application systems even if this algorithm is not used. For example, in some digital hearing aids, one FFT and one IFFT are needed so as to calculate the compression ratio in different perceptual frequency bands. Another example is spectral subtraction algorithm related systems, where at least one FFT and one IFFT are also required. This means that the cost of the inclusion of the proposed adaptive directionality algorithm in the application systems is only one more FFT operation. Together with the fact that the structure and DSP code to perform the FFT of Y(n) can be exactly the same as those to perform the FFT of X(n), it can be seen that the real-time implementation of this scheme is not difficult.

In the present scheme, the geometric structure and distance of these dual microphones are not specified at all. They could be either broad orientation or endfire orientation. For hearing-aid applications, the endfire orientation is often used. With the endfire orientation, if Griffiths-Jim's type adaptive directionality algorithms are employed, a constant delay (which is about d/c, d is the distance between two microphones, c is the speed of sound) is needed so as to provide a reference signal which is the difference signal X(n*T−d/c)−X(n*T) (T is the sample interval) and contains ideally only the noise signal part. However, the distance d of microphones (for example, 12 mm in behind-the-ear hearing aids) is too short and hence the required delay (34.9 μs in this example) will be less than a sample interval (for example, the sample interval is 62.5 μs for 16 Khz sampling rate). This will result in additional processing unit either by increasing sampling rate or by combining its realization during analog-to-digital converter of X(n) channel. The implementation of this constant delay is also necessary for achieving fixed directionality pattern such as hypercardiod type pattern. It can easily be seen that the present algorithm does not need this constant delay part. This advantage makes the implementation of the algorithms of the present invention even simpler.

Figure 4:
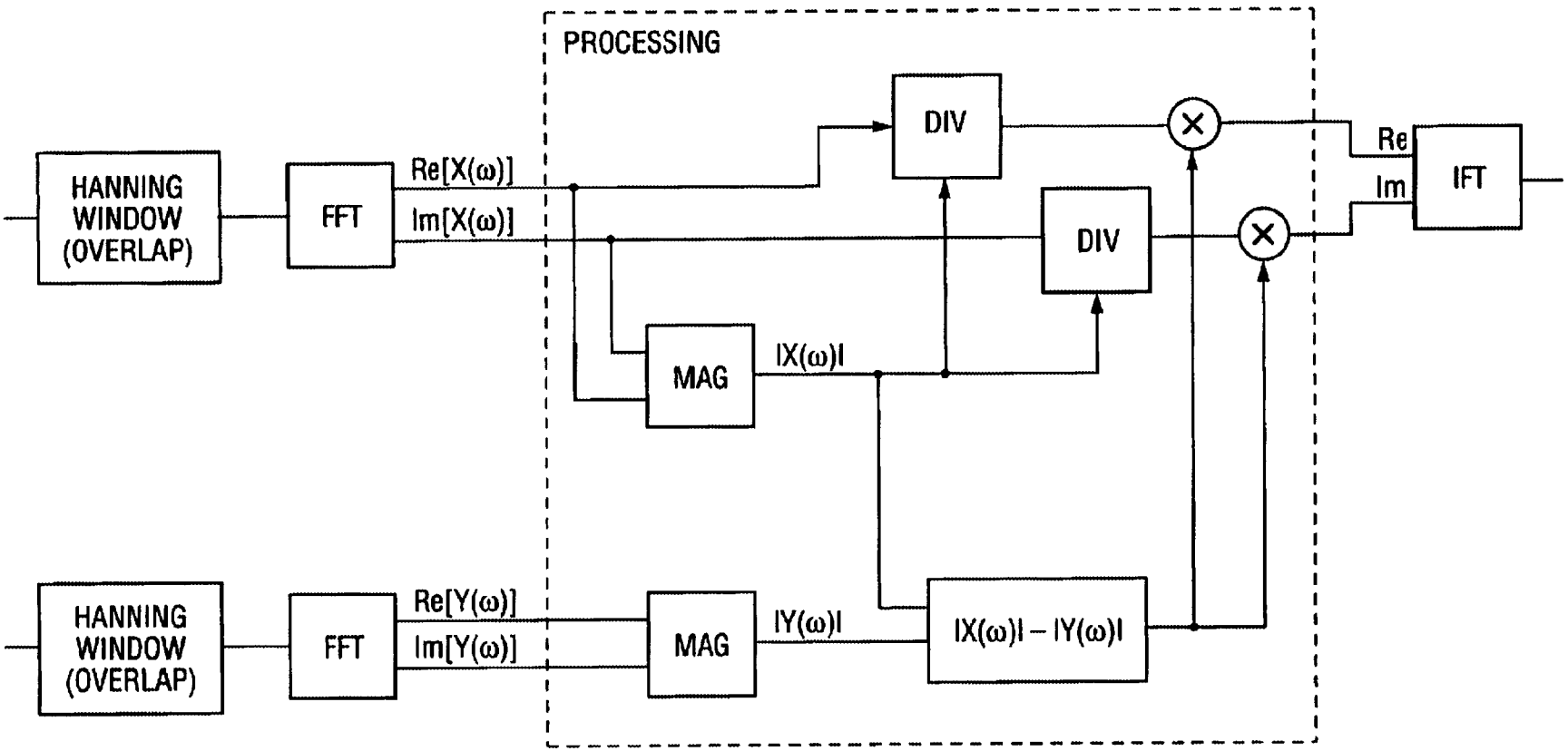
FIG. 4 is a diagram of one implementation of the apparatus of FIG. 3.
Figure 5A:
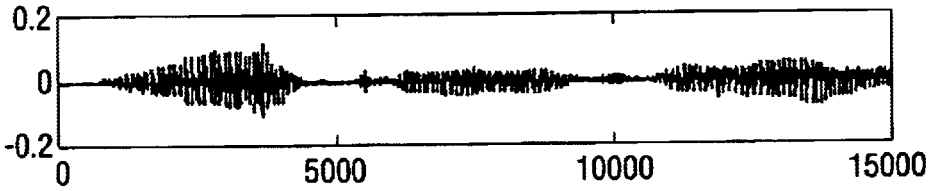
FIGS. 5 and 6 are simulations illustrating the operation of the system of one embodiment of the present invention.
Figure 5B:
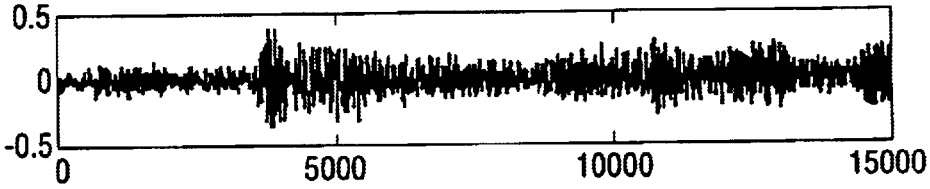
Figure 5C:
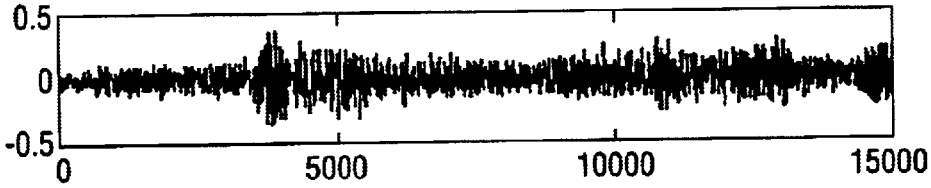
Figure 5D:
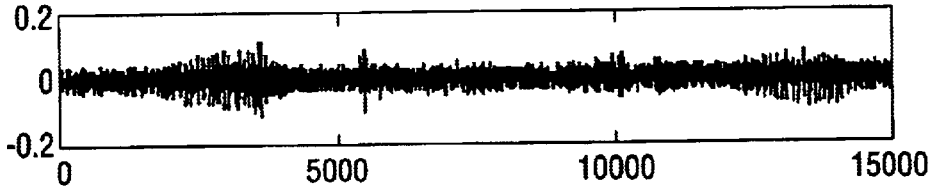
Figure 6A:
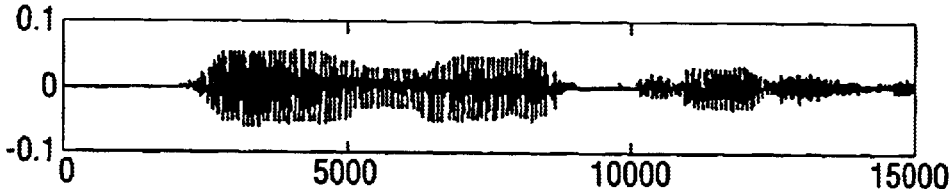
Figure 6B:
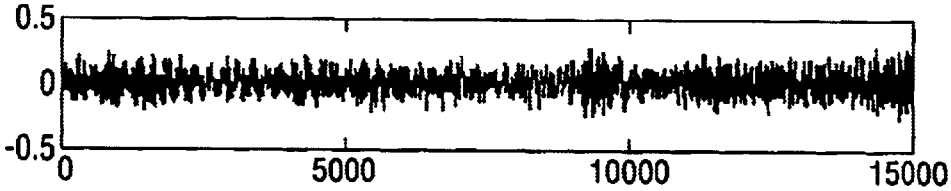
Figure 6C:
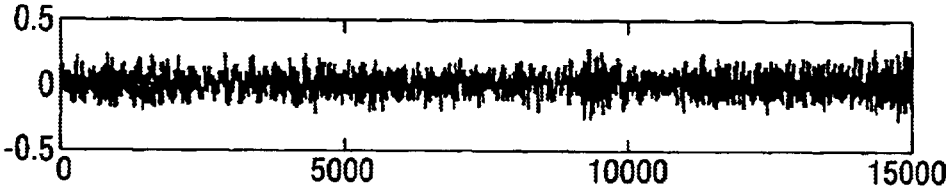
Figure 6D:
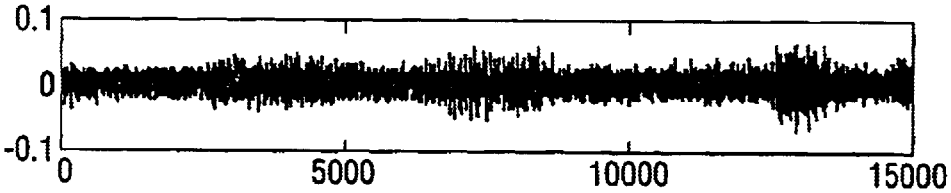

FIG. 4 illustrates an implementation of the present invention in which an equivalent calculation is done to Equation 1. This equivalent calculation is in the form $$\begin{aligned} Z(\omega) &= X(\omega) - X(\omega)\frac{|Y(\omega)|}{|X(\omega)|} \\ &= X(\omega)\left[1 - \frac{|Y(\omega)|}{|X(\omega)|}\right] \\ &= X(\omega)\frac{|X(\omega)| - |Y(\omega)|}{|X(\omega)|} \\ &= \frac{|X(\omega)|}{|X(\omega)|}[|X(\omega)| - |Y(\omega)|] \\ &= \left[\frac{X_{re}(\omega)}{|X(\omega)|} + j\frac{X_{im}(\omega)}{|X(\omega)|}\right][|X(\omega)| - |Y(\omega)|] \end{aligned}$$

The advantage of this equivalent calculation is that it is done in a manner such that the data in each of the division calculation steps can be assured to be within the range −1 to 1, typically used with digital signal processors.

FIG. 5 is a set of simulation results for one embodiment of the present invention. FIG. 5A is the desired speech. FIG. 5B is the noise. FIG. 5C is the combined signal and noise. FIG. 5D is a processed output.

FIG. 6 is another set of simulation results for the method of the present invention. FIG. 6A is the desired speech. FIG. 6B is the noise. FIG. 6C is the combined signal and noise. FIG. 6D is a processed signal.

Figure 7:
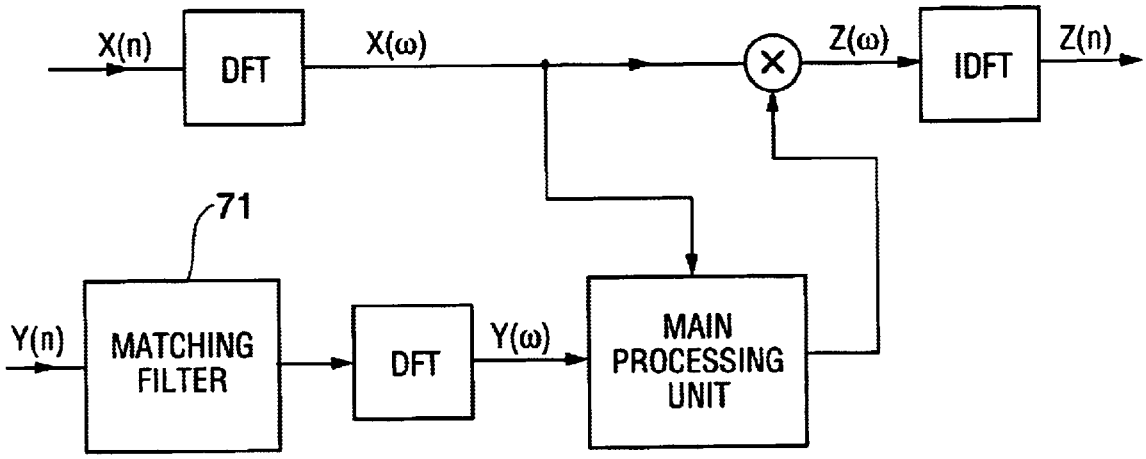
FIG. 7 is a diagram that illustrates an embodiment of the present invention using a matching filter.

FIG. 7 illustrates how a matching filter 71 can be added to match the output of the microphones. In most available adaptive directionality algorithms, the magnitude response and phase response of two microphones are assumed to be the same. However, in practical applications, there is a significant mismatch in phase and magnitude between two microphones. It is the significant mismatch in phase and magnitude that will result in a degraded performance of these adaptive directionality algorithms and that is one of the main reasons to prevent these available algorithms from being used in practical applications. For example, in the Griffiths-Jim's type adaptive directionality algorithms, the mismatch means that there is some of the target signal in the reference signal and the assumption that the reference signal contains only the noise no longer exists and hence the system will reduce not only the noise but also the desired signal. Because it is not difficult to measure the mismatch of magnitude responses of two microphones, we can include a matching filter in either of two channels so as to compensate for the mismatch in magnitude response as shown in FIG. 7. The matching filter 71 may be an Infinite Impulse Response (IIR) filter. With careful design, a first-order IIR can compensate for the mismatch in magnitude response very well. As a result, mismatch problems in magnitude can be effectively overcome by this idea. However, concerning the phase mismatch, the problem will become more complicated and serious. First, it is difficult to measure phase mismatch for each device in application situations. Second, even if the phase mismatch measurement is available, the corresponding matching filter would be more complicated, that is, a simple (with first- or second-order) filter can not effectively compensate for the phase mismatch. In addition, the matching filter for compensation for magnitude mismatch will introduce its own phase delay; this means that both phase mismatch and magnitude mismatch have to be taken into account simultaneously in designing the desired matching filter. All these remain unsolved problems in prior-art adaptive directionality algorithms.

In the present scheme, these problems are effectively overcome. First, the magnitude mismatch of two microphones can be overcome by employing the magnitude matching filter 71. Second, as mentioned above, $\psi_{nd}(\omega)$ has included all the phase delay parts no matter where they come from, so we do not encounter the phase mismatch problem at all in the present scheme.

In most available adaptive directionality algorithms, there is an assumption that the desired speech source is located exactly straight ahead. This assumption cannot be exactly met in some applications or can result in some inconvenience for users. For example, in some hearing aid applications, this assumption means that the listener must be always towards straight the target speech source, otherwise, the system performance will greatly degrade. However, in the present scheme, this assumption has been eliminated, that is, the target speech source and noise source can be located anywhere as long as they are not located in the same direction.

A potential shortcoming of the present scheme is that its performance will degrade in larger signal-to-noise ratio (SNR) cases. This is a common problem in related adaptive directionality schemes. This problem has two aspects. If the SNR is large enough, noise reduction is no longer necessary and hence the adaptive directionality can be switched off or other noise reduction methods which work well only in large SNR case can be used. In the other aspect, we can first use the detection of the speech pause and estimate the related phase during this pause period and then modify Equation 1 to $$Z(\omega) = X(\omega) - Y(\omega)\frac{|Y(\omega)|_p}{|X(\omega)|_p}\frac{X(\omega)_p}{Y(\omega)_p}$$

where $X(\omega)_p$, $Y(\omega)_p$ and $|X(\omega)|_p$, $|Y(\omega)|_p$ are the DFT output and its magnitide part during the pause period of the target speech. This modification can overcome the above shortcoming but the cost is more computationally complex due to the inclusion of the detection of the speech pause.

Figure 8:
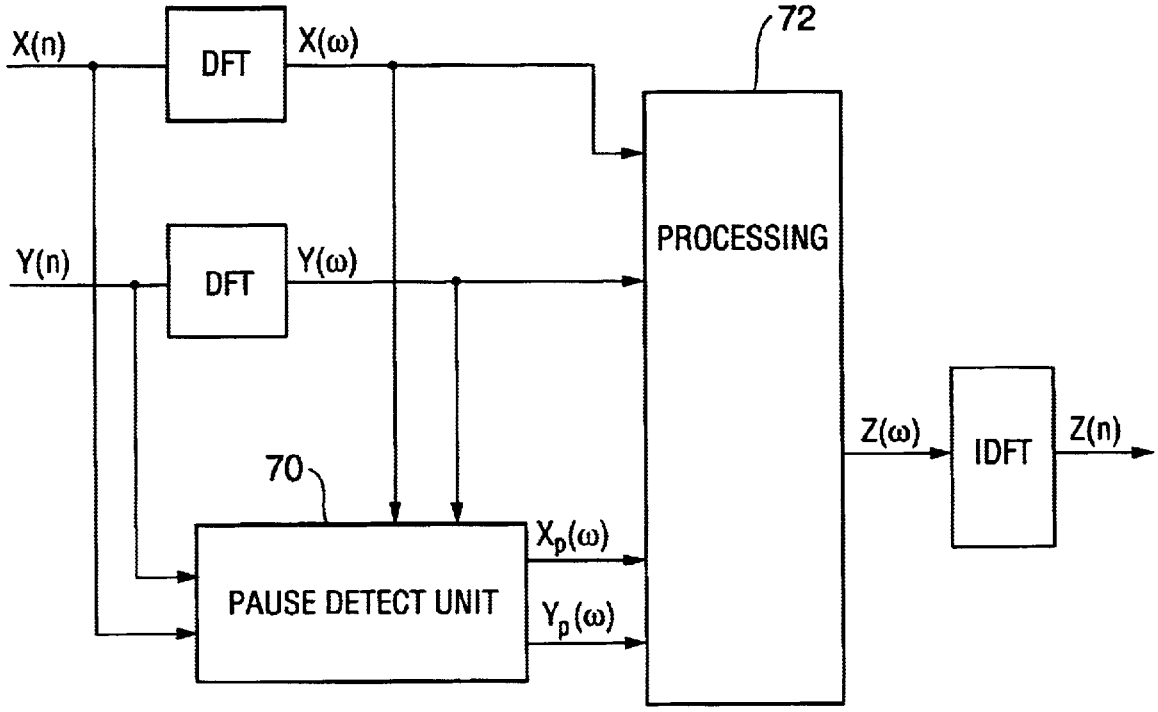
FIG. 8 is a diagram that illustrates the operation of one embodiment of the present invention using pause detection.

FIG. 8 illustrates the system of the present invention in which pause-detection circuitry 70 is used to detect pauses and store frequency-domain data during the pauses. The frequency-domain data in the speech pause is used to help obtain the phase information of the noise signal and thus improve the noise cancellation function.

Note that the processing block 72 uses a function of the stored frequency domain data in a speech pause to help calculate the desired noise cancelled frequency domain data. During the target speech pause, the phase of the detected signals is approximately equal to the noise phase even if the total SNR is relatively high.

Figure 9:
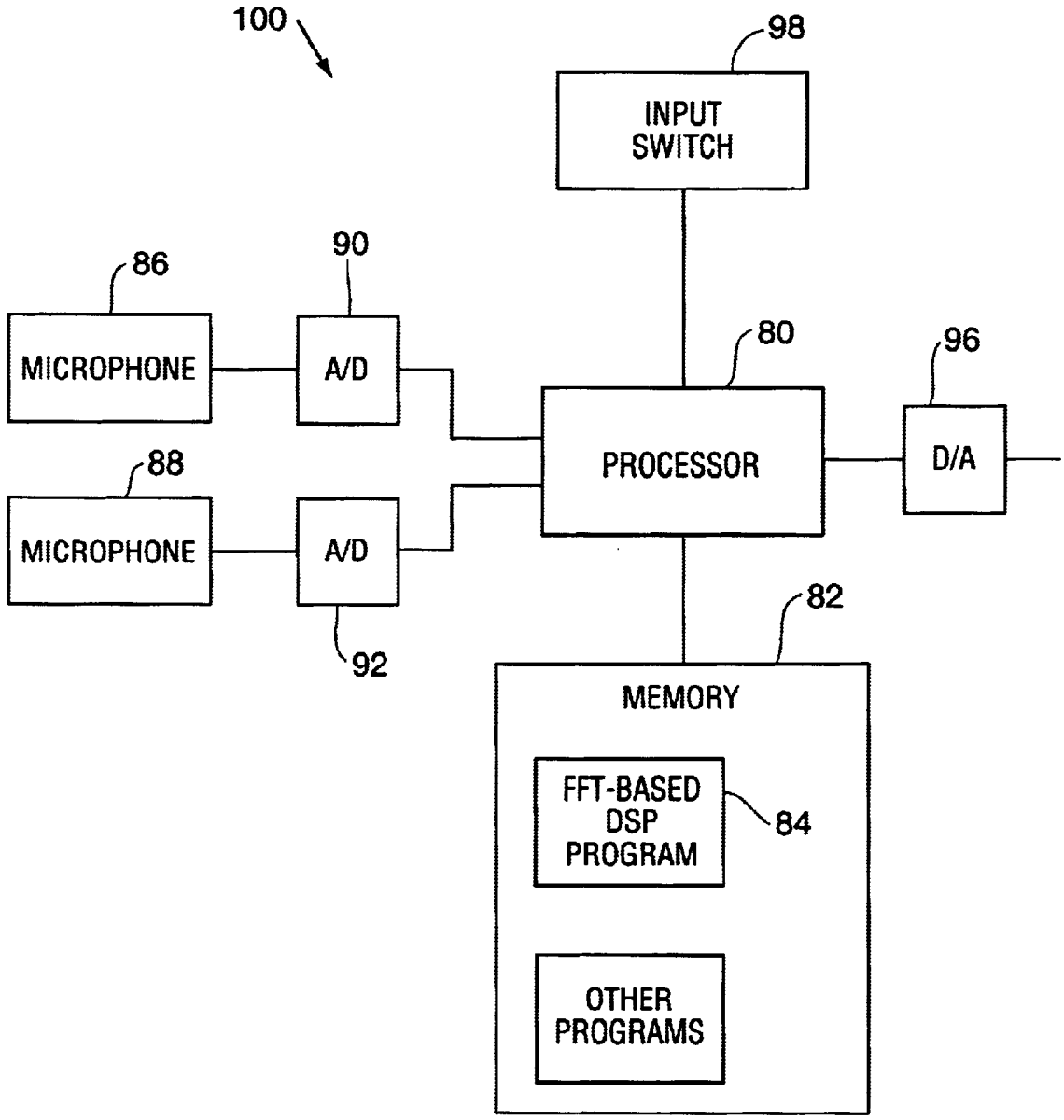
FIG. 9 is a diagram that illustrates an embodiment of the present invention wherein the adaptive directionality system of the present invention is implemented on a digital signal processor.

FIG. 9 illustrates one implementation of the present invention. The system of one embodiment of the present invention is implemented using a processor 80 connected to a memory or memories 82. The memory or memories 82 can store the DSP program 84 that can implement the FFT-based adaptive directionality program of the present invention. The microphone 86 and microphone 88 are connected to A/D converters 90 and 92. This time domain data is then sent to the processor 80 which can operate on the data similar to that shown in FIGS. 3, 4, 7 and 8 above. In a preferred embodiment, the processor implementing the program 84 does the Hanning window functions, the discrete Fourier Transform functions, the noise-cancellation processing, and the Inverse Discrete Fourier Transform functions. The output time domain data can then be sent to a D/A converter 96. Note that additional hearing-aid functions can also be implemented by the processor 80 in which the FFT-based adaptive directionality program 84 of the present invention shares processing time with other hearing-aid programs.

In one embodiment of the present invention, the system 100 can include an input switch 98 which is polled by the processor to determine whether to use the program of the present invention or another program. In this way, when the conditions do not favor the operation of the system of the present invention (that is, when the signal is stronger than the noise or when the signal and the noise are co-located), the user can switch in another adaptive directionality program to operate in the processor 80.

Several alternative methods with the same function and working principles can be obtained by use of some modifications which mainly include the following respects:

1. A matching filter could be added in either of dual microphones before performing FFT so as to conpensate for the magnitude mismatch of two microphones as FIG. 7 shows. The matching filter can be either an FIR filter or an IIR filter.

2. Direct summation of Equation 1 with Equation 2 for the purpose of further increasing the output SNR, that is, $$Z(\omega) = X(\omega) - X(\omega)\frac{|Y(\omega)|}{|X(\omega)|} + Y(\omega) - Y(\omega)\frac{|X(\omega)|}{|Y(\omega)|}$$

3. In hearing aid applications, in one embodiment the output provided by Equation 1 is provided to one ear and the output provided by Equation 2 is provided to the other ear so as to achieve binaural results.

4. Equation 1 and Equation 2 are equivalent to the following, respectively:

$$Z(\omega) = (|X(\omega)| - |Y(\omega)|)\left(\frac{\mathrm{Re}(X(\omega))}{|X(\omega)|} + j\frac{\mathrm{Im}(X(\omega))}{|X(\omega)|}\right) \text{ or}$$

$$Z(\omega) = (|Y(\omega)| - |X(\omega)|)\left(\frac{\mathrm{Re}(Y(\omega))}{|Y(\omega)|} + j\frac{\mathrm{Im}(Y(\omega))}{|Y(\omega)|}\right)$$

which can avoid the problem that the nominator is larger than the denominator in hardware implementation of the division.

5. Equation 1 and Equation 2 can also be modified to the following, respectively, with the inclusion of the detection of the speech pause:

$$Z(\omega) = X(\omega) - Y(\omega)\frac{|Y(\omega)|_P}{|X(\omega)|_P}\frac{X(\omega)_P}{Y(\omega)_P}$$

where $X(\omega)_p$, $Y(\omega)_p$, and $|X(\omega)|_p$, $Y(\omega)|_p$ are the DFT and its magnitude part of X(n) and Y(n) during the pause period of the target speech.

$$Z(\omega) = Y(\omega) - X(\omega)\frac{|X(\omega)|_P}{|Y(\omega)|_P}\frac{Y(\omega)_P}{X(\omega)_P}$$

It will be appreciated by those of ordinary skill in the art that the invention can be implemented in other specific forms without departing from the spirit or character thereof. The presently disclosed embodiments are therefore considered in all respects to be illustrative and not restrictive. The scope of the invention is illustrated by the appended claims rather than the foregoing description, and all changes that come within the meaning and range of equivalents thereof are intended to be embraced herein.

What is claimed is:

1. An apparatus comprising:

a first microphone;

a second microphone;

at least one analog-to-digital converter adapted to convert first and second analog microphone outputs into first and second digital time-domain data; and processing means receiving the digital time domain data, the processing means including, a first Discrete Fourier Transform block converting the first digital time-domain data into a first digital frequency-domain data, a second-Discrete Fourier Transform block converting the second digital time-domain data into a second digital frequency-domain data, a noise canceling processing block operating on the first and second digital frequency-domain data to produce noise-canceled digital frequency-domain data, the noise-canceled digital frequency-domain data being a function of the first and second digital frequency-domain data that effectively cancels noise when the noise is greater than a target signal and the noise and the target signal are not in the same direction from the apparatus, the function providing adaptive directionality to cancel the noise, and an Inverse Discrete Fourier Transform block converting the noise-canceled digital frequency-domain data into noise-canceled digital time-domain data, wherein if $X(\omega)$ represents one of the first and second digital frequency-domain data and $Y(\omega)$ represents the other of the first and second digital frequency-domain data, and the function is proportional to $X(\omega)[1-|Y(\omega)|/|X(\omega)|]$.

2. The apparatus of claim 1, wherein the first and second digital frequency-domain data and noise-canceled digital frequency-domain data each includes real and imaginary parts, wherein $X_{re}(\omega)$ represents the real portion of one of the first and second digital frequency-domain data, $X_{im}(\omega)$ represents the imaginary portion of the one of the first and second digital frequency-domain data, $Y_{re}(\omega)$ represents the real portion of the other of the first and second digital frequency-domain data, $Y_{im}(\omega)$ represents the imaginary portion of the other of the first and second digital frequency-domain data, wherein the function is implemented by calculating $[X_{re}(\omega)/|X(a)|+jX_{im}(\omega)/|X(\omega)|]\cdot[|X(\omega)|-|Y(\omega)|]$.

3. An apparatus comprising:

a first microphone;

a second microphone;

at least one analog-to-digital converter adapted to convert first and second analog microphone outputs into first and second digital time-domain data;

processing means receiving the digital time domain data, the processing means including, a first Discrete Fourier Transform block converting the first digital time-domain data into a first digital frequency-domain data, a second Discrete Fourier Transform block converting the second digital time-domain data into a second digital frequency-domain data, a noise canceling processing block operating on the first and second digital frequency-domain data to produce noise-canceled digital frequency-domain data, the noise-canceled digital frequency-domain data being a function of the first and second digital frequency-domain data that effectively cancels noise when the noise is greater than a target signal and the noise and the target signal are not in the same direction from the apparatus, the function providing adaptive directionality to cancel the noise, and an Inverse Discrete Fourier Transform block converting the noise-canceled digital frequency-domain data into noise-canceled digital time-domain data; and elements to detect pauses in a speech signal, wherein if $X(\omega)$ represents one of the first and second digital frequency-domain data, $Y(\omega)$ represents the other of the first and second digital frequency-domain data, $X_p(\omega)$ represents the one of the first and second digital frequency-domain data during a pause and $Y_p(\omega)$ represents the other of the first and second digital frequency-domain data during the pause, and the function is proportional to $X(\omega)-Y(\omega)[|Y(a)|_p/|X(\omega)|_p][X_p(\omega)/Y_p(\omega)]$.

4. An apparatus comprising:

a first microphone;

a second microphone;

at least one analog-to-digital converter adapted to convert first and second analog microphone outputs into first and second digital time-domain data;

processing means receiving the digital time domain data, the processing means including a first Discrete Fourier Transform block converting the first digital time-domain data into a first digital frequency-domain data, a second Discrete Fourier Transform block converting the second digital time-domain data into a second digital frequency-domain data, a noise canceling processing block operating on the first and second digital frequency-domain data to produce noise-canceled digital frequency-domain data, wherein if $X(\omega)$ represents one of the first and second digital frequency-domain data and $Y(\omega)$ represents the other of the first and second digital frequency-domain data, the noise-canceled digital frequency-domain data is represented by $Z(\omega)$ where $Z(\omega)$ is proportional to $Y(\omega)[1-|X(\omega)|/|Y(\omega)|]$, and an Inverse Discrete Fourier Transform block converting the noise-canceled digital frequency-domain data into noise-canceled digital time-domain data.

5. The apparatus of claim 4, wherein the first and second digital frequency-domain data and noise-canceled digital frequency-domain data each includes real and imaginary parts, wherein $X_{re}(\omega)$ represents the real portion of one of the first and second digital frequency-domain data, $X_{im}(\omega)$ represents the imaginary portion of the one of the first and second digital frequency-domain data, $Y_{re}(\omega)$ represents the real portion of the other of the first and second digital frequency-domain data, $Y_{im}(\omega)$represents the imaginary portion of the other of the first and second digital frequency-domain data, where $Z(\omega)$ is determined by calculating $[Y_{re}(\omega)/|Y(\omega)|+jY_{im}(\omega)/|Y(\omega)|]\cdot[|Y(\omega)|-X(\omega)|]$.

6. The apparatus of claim 4, wherein the first and second digital frequency-domain data and noise-canceled digital frequency-domain data each includes real and imaginary parts, wherein $X_{re}(\omega)$ represents the real portion of one of the first and second digital frequency-domain data, $X_{im}(\omega)$ represents the imaginary portion of the one of the first and second digital frequency-domain data, $Y_{re}(\omega)$ represents the real portion of the other of the first and second digital frequency-domain data, $Y_{im}(\omega)$represents the imaginary portion of the other of the first and second digital frequency-domain data, where $Z(\omega)$ is determined by calculating $[Y_{re}(\omega)/|Y(\omega)|+jY_{im}(\omega)/|Y(\omega)|]\cdot[|Y(\omega)|-X(\omega)|]$.

7. A method comprising:

converting first and second analog microphone outputs from first and second microphones into first and second digital time-domain data:

producing noise-canceled digital frequency-domain data from the first and second digital frequency-domain data, the noise-canceled digital frequency-domain data being a function of the first and second digital frequency-domain data that effectively cancels noise when the noise is greater than a target signal and the noise and the target signal are not in the same direction from the apparatus, the function providing adaptive directionality to cancel the noise, wherein if $X(\omega)$ represents one of the first and second digital frequency-domain data and $Y(\omega)$ represents the other of the first and second digital frequency-domain data, the noise-canceled digital frequency-domain data is represented by $Z(\omega)$ where $Z(\omega)$ is proportional to $X(\omega)[1-|Y(\omega)|/|X(\omega)|]$; and converting the noise-canceled digital frequency-domain data into noise-canceled digital time-domain data.

8. A method comprising:

converting first and second analog microphone outputs from first and second microphones into first and second digital time-domain data:

producing noise-canceled digital frequency-domain data from the first and second digital frequency-domain data, the noise-canceled digital frequency-domain data being a function of the first and second digital frequency-domain data that effectively cancels noise when the noise is greater than a target signal and the noise and the target signal are not in the same direction from the apparatus, the function providing adaptive directionality to cancel the noise;

converting the noise-canceled digital frequency-domain data into noise-canceled digital time-domain data; and detecting pauses in a speech signal, wherein if $X(\omega)$ represents one of the first and second digital frequency-domain data, $Y(\omega)$ represents the other of the first and second digital frequency-domain data, $X_p(\omega)$ represents the one of the first and second digital frequency-domain data during the pause and $Y_p(\omega)$ represents the other of the first and second digital frequency-domain data during the pause, and the function is proportional to $X(\omega)-Y(\omega)[|Y(\omega)|_p/|X(\omega)|_p][X_p(\omega)/Y_p(\omega)]$.

9. A method comprising converting first and second analog microphone outputs from first and second microphones into first and second digital time-domain data;

converting the first and second digital time-domain data into a first and second digital frequency-domain data;

producing noise-canceled digital frequency-domain data from the first and second digital frequency-domain data, wherein if $X(\omega)$ represents one of the first and second digital frequency-domain data and $Y(\omega)$ represents the other of the first and second digital frequency-domain data, the noise-canceled digital frequency-domain data is represented by $Z(\omega)$ where $Z(\omega)$ is proportional to $Y(\omega)[1-|X(\omega)|/|Y(\omega)|]$; and converting the noise-canceled digital frequency-domain data into noise-canceled digital time-domain data.

10. The method of claim 9, wherein the first and second digital frequency-domain data and noise-canceled digital frequency-domain data each includes real and imaginary parts, wherein $X_{re}(\omega)$ represents the real portion of one of the first and second digital frequency-domain data, $X_{im}(\omega)$ represents the imaginary portion of the one of the first and second digital frequency-domain data, $Y_{re}(\omega)$ represents the real portion of the other of the first and second digital frequency-domain data, $Y_{im}(\omega)$ represents the The method of claim 9, wherein the first and second digital frequency-domain data and noise-canceled digital frequency-domain data each includes real and imaginary parts, wherein $X_{re}(\omega)$ represents the real portion of one of the first and second digital frequency-domain data, $X_{im}(\omega)$ represents the imaginary portion of the one of the first and second digital frequency-domain data, $Y_{re}(\omega)$ represents the real portion of the other of the first and second digital frequency-domain data, $Y_{im}(\omega)$ represents the imaginary portion of the other of the first and second digital frequency-domain data, where $Z(\omega)$ is determined by calculating $[Y_{re}(\omega)/|Y(\omega)|+jY_{im}(\omega)/|Y(\omega)|][|Y(\omega)|-|X(\omega)|]$.

* * * * *